United States Patent [19]

Peters

[11] Patent Number: 4,694,808

[45] Date of Patent: Sep. 22, 1987

[54] METHOD AND FUEL INJECTION SYSTEM FOR FUEL SUPPLY TO A MIXTURE-COMPRESSING INTERNAL COMBUSTION ENGINE HAVING EXTERNALLY SUPPLIED IGNITION

[75] Inventor: Klaus-Jürgen Peters, Affalterbach, Fed. Rep. of Germany

[73] Assignee: Robert Bosch GmbH, Stuttgart, Fed. Rep. of Germany

[21] Appl. No.: 410,099

[22] Filed: Aug. 20, 1982

[30] Foreign Application Priority Data

Oct. 15, 1981 [DE] Fed. Rep. of Germany ..... 3140948

[51] Int. Cl.[4] ..... F02M 39/00

[52] U.S. Cl. ..... 123/453; 123/454

[58] Field of Search ..... 123/453, 454, 452, 299, 123/447

[56] References Cited

U.S. PATENT DOCUMENTS

| | | | |
|---|---|---|---|
| 3,994,273 | 11/1976 | Stumpp | 123/454 |
| 4,161,964 | 7/1979 | Greiner et al. | 123/447 |
| 4,214,565 | 7/1980 | Knapp et al. | 123/454 |
| 4,257,375 | 3/1981 | Ulrich | 123/453 |
| 4,326,487 | 4/1982 | Maisch et al. | 123/453 |
| 4,354,472 | 10/1982 | Knapp et al. | 123/454 |
| 4,381,751 | 5/1983 | Maisch et al. | 123/454 |

FOREIGN PATENT DOCUMENTS

| | | | |
|---|---|---|---|
| 2754373 | 6/1979 | Fed. Rep. of Germany | 123/453 |

*Primary Examiner*—Craig R. Feinberg

*Attorney, Agent, or Firm*—Edwin E. Greigg

[57] ABSTRACT

A method and a fuel injection system for supplying fuel to a mixture-compressing internal combustion engine having externally supplied ignition is proposed. The fuel injection system includes metering valves, downstream of which regulating valves are disposed and at one side of which the fuel pressure downstream of the metering valves prevails and on the other side of which the fuel pressure in a control pressure line prevails. The control pressure line communicates with the fuel supply line and is limited by a control throttle and a return-flow throttle; from it, a branch line leads to an electromagnetic supplementary injection valve, by way of which further fuel, in addition to the fuel injected via injection valves, can be injected. The triggering of the supplementary injection valve can be effected by an electronic control unit for injecting fuel during cold starting of the engine or in the presence of a measurement signal characterizing an acceleration of the engine. By means of the triggering of the supplementary injection valve, the pressure in the control pressure line is reduced, as a result of which--because of an increase in the pressure difference at the metering valves--a greater fuel quantity is metered.

9 Claims, 1 Drawing Figure

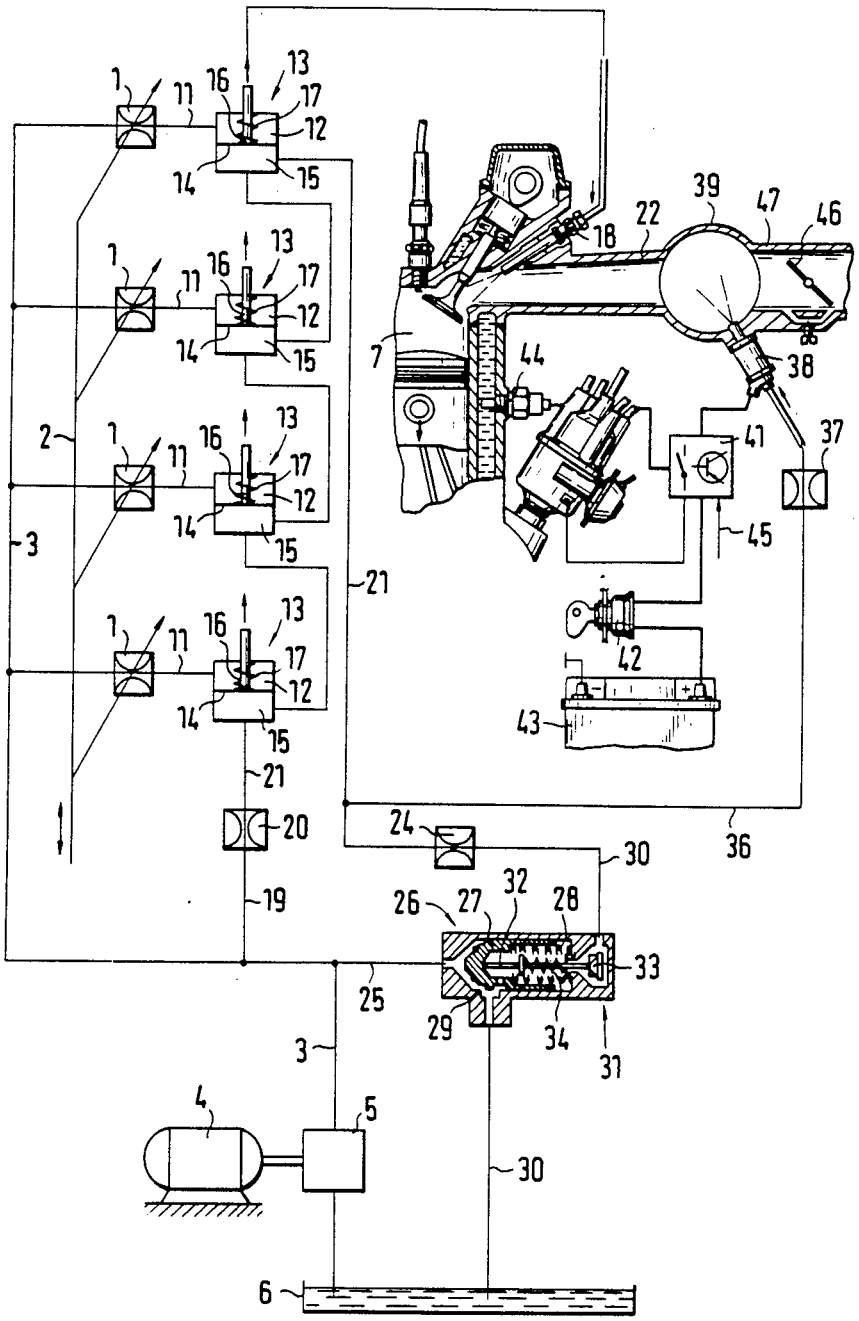
1
11
16
13
17
12
14
15
2
3
21
20
19
24
30
36
26
27
32
28
33
25
29
34
31
4
5
6
7
18
22
39
47
46
44
38
41
37
45
42
43

METHOD AND FUEL INJECTION SYSTEM FOR FUEL SUPPLY TO A MIXTURE-COMPRESSING INTERNAL COMBUSTION ENGINE HAVING EXTERNALLY SUPPLIED IGNITION

BACKGROUND OF THE INVENTION

The invention relates to a method as generally defined hereinafter and also to a fuel injection system. A method and a fuel injection apparatus are already known in which when the engine is started, fuel is injected into the air intake tube of the engine via a supplementary, electromagnetically actuated injection valve. In order to enrich the fuel-air mixture at predetermined operating conditions of the engine, it is known to increase the pressure drop at the metering valves by reducing a control pressure by means of an electromagnetically actuatable control pressure valve.

OBJECT AND SUMMARY OF THE INVENTION

The method according to the present invention in which a fuel injection system for supplying fuel to a mixture-compressing internal combustion engine having externally supplied ignition has the advantage over the prior art in that a high enrichment factor for the fuel-air mixture can be attained at reduced expense by using only a single supplementary, electromagnetically actuatable injection valve.

Advantageous further embodiments of and improvements to the fuel injection system disclosed hereinafter can be attained by means of supplementary sensing and control operations.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows one exemplary embodiment of the apparatus according to the invention, which is described in further detail below.

DESCRIPTION OF THE PREFERRED EMBODIMENT

In the fuel injection system according to the example in the drawing there are a plural number of metering valves 1, each one of which is associated with each cylinder 7 of a mixture-compressing internal combustion engine having externally supplied ignition by which a quantity of fuel is metered which is in a specific proportion to a quantity of air aspirated by the engine. The fuel injection system shown by way of example has four metering valves 1 and is thus intended for use in a four-cylinder engine. The cross section of the metering valves 1 is variable in common, as indicated in the drawing, by means of an actuation element 2 in accordance with operating characteristics of the engine; for instance, the cross section can be varied in accordance with the quantity of air aspirated by the engine. The metering valves 1 are located in a fuel supply line 3, into which fuel is pumped from a fuel container 6 by a fuel pump 5 driven by an electric motor 4.

Downstream of each metering valve 1 there is a line 11, by way of which the metered fuel passes into a regulating chamber 12 of a regulating valve 13 associated separately with each individual metering valve 1. The regulating chamber 12 of the regulating valve 13 is separated by a movable valve element, embodied as a diaphragm 14, from a control chamber 15 of the regulating valve 13. The diaphragm 14 of the regulating valve 13 cooperates with a fixed valve seat 16 provided in the regulating chamber 12. The metered fuel is capable of flowing out of the regulating chamber 12 via this valve seat 16 to the individual injection valves 18 at each individual intake tube 22 of the engine. A spring 17, which urges the diaphragm 14 in the opening direction of the regulating valve 13, may also be disposed in the regulating chamber 12.

A line 19 branches off from the fuel supply line 3 and discharges via a control throttle 20 into a control pressure line 21. Downstream of the control throttle 20 in the control pressure line 21 are the control chambers 15 of the regulating valves 13, and downstream of the control chambers 15 there is a return-flow throttle 24. Also branching off from the fuel supply line 3 is a line 25 in which a pressure regulating valve 26 is disposed for maintaining a constant fuel pressure upstream of the fuel metering valves 1. The pressure regulating valve 26 shown by way of example in the drawing has a regulating piston 27 which can be displaced counter to the force of a regulating spring 28 by the pressure of the fuel in the line 25 so that fuel can flow over a regulating edge 29 out of the line 25 into a return-flow line 30 and back to the fuel container 6. A blocking valve 31 can simultaneously be opened by the regulating piston 27 as it effects an opening operation. To this end, the regulating piston 27, as it effects an opening operation and while the fuel pump 5 is pumping, engages an actuation pin 32, which displaces the movable valve element 33 of the blocking valve 31 in the opening direction, counter to the force of a blocking spring 34. If the engine is shut off, then no further fuel supply is effected via the electric fuel pump 4, 5, and the pressure regulating valve 26 closes. At the same time, the blocking spring 34 engaging the actuation pin 32 displaces the movable valve element 33 of the blocking valve 31 into the closing position.

Downstream of the return-flow throttle 24 the fuel reaches the return-flow line 30 in which the blocking valve 31 is also disposed. When the fuel pump is not pumping, the closed blocking valve 31 prevents fuel from leaking out of the control pressure line 31, and thus allows the fuel injection system to remain filled with fuel for the next time the engine is started.

From the control pressure line 21 downstream of the control throttle 20, a branch line 36 leads via a limitation throttle 37 to an electromagnetically actuatable supplementary injection valve 38, by way of which fuel can be injected into the air intake tube 47 or into the intake manifold 39 upstream of the individual intake tubes 22. The supplementary injection valve 38 is triggerable by means of an electronic control unit 41 which is supplied by the vehicle battery 43 via an ignition switch 42. In addition to the engine temperature being ascertained by means of a temperature sensor 44, a measurement signal 45 characterizing an acceleration of the engine can be fed to the electronic control unit 41. The measurement signal 45 is ascertained in a known manner, for instance by means of a differentiating pressure switch (not shown), which responds to a variation in the pressure drop at the throttle valve 46 in the air intake tube 47.

By means of the supplementary injection valve 38, a supplementary quantity of fuel can be injected into the air intake tube 47 or the intake manifold 39 in a known manner, in accordance with engine temperature for a limited time period during a cold start of the engine, which effects an enrichment of the fuel-air mixture, and makes for reliable starting of the engine. The supplementary injection valve 38 can be furthermore triggered by the electronic control device in such a manner that it opens whenever a measurement signal 45 characterizing engine acceleration is present at the electronic control unit 41. The opening of the supplementary injection valve 38 effects not only an enrichment of the fuel-air mixture because of the injection of fuel by way of the supplementary injection valve 38, but it also simultaneously effects a reduction of pressure in the control pressure line 21; this unique operation results in an identical reduction of pressure in the regulating chambers 12 of the regulating valves 13, thus increasing the pressure difference at the metering valves 1 and causing the metering of a greater quantity of fuel. The enrichment of the fuel-air mixture is thus effected simultaneously via an increased quantity of fuel injected via the injection valves 18 and a supplementary fuel quantity injected via the supplementary injection valve 38. As a result, a very high enrichment rate can be attained.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for supplying fuel to a mixture-compressing internal combustion engine having an air intake tube and externally supplied ignition by means of a fuel injection system having metering valve means disposed in a fuel supply line for metering a quantity of fuel at a specific proportion to the quantity of air aspirated by said engine, a control pressure line communicating with said fuel supply line, and having individual injection valve means, comprising the steps of:

injecting the metered fuel ahead of each cylinder of said engine; and further injecting fuel into the air-intake tube of said engine by means of a supplementary injection valve means in accordance with engine operating characteristics, whereby the pressure in said control pressure line is reduced by means of said supplementary injection valve means, and the pressure difference at said metering valve means is increased to thereby increases the metered fuel quantity transmitted by means of said individual injection valve means.

2. A method for supplying fuel to a mixture-compressing internal combustion engine having an air intake tube and externally supplied ignition by means of a fuel injection system having metering valve means disposed in a fuel supply line for metering a quantity of fuel at a specific proportion to the quantity of air aspirated by said engine, the metering being effected at a pressure difference which is constant yet can be varied in accordance with operating characteristics of the engine, a movable valve element of a regulating valve disposed downstream of each of said metering valve means for regulating the pressure difference at each of said metering valve means, a control pressure line which communicates with said fuel supply line and is limited at one end by a control throttle means and at the other end by a return-flow throttle means and leads to a return-flow line, and having individual injection-valve means, comprising the steps of:

injecting the metered fuel ahead of each cylinder of said engine; and further injecting fuel into the air-intake tube of said engine by means of a supplementary injection valve means in accordance with engine operating characteristics, whereby the pressure in said control pressure line is reduced by means of the supplementary injection valve means, and the pressure difference at said metering valve means is increased to thereby increase the metered fuel quantity transmitted by means of said individual injection valve means.

3. A method as defined by claim 2, wherein said supplementary injection valve, for enrichment of the fuel-air mixture, is electromagnetically actuatable and triggerable in accordance with control signals characterizing an acceleration of said engine.

4. A method as defined by claim 2, wherein said supplementary injection valve, for enrichment of the fuel-air mixture, is electromagnetically actuatable and triggerable upon the starting of said engine.

5. A fuel injection system for supplying fuel to a mixture-compressing internal combustion engine having an air intake tube and externally supplied ignition comprising:

metering valve means disposed in a fuel supply line for metering a quantity of fuel at a specific proportion to the quantity of air aspirated by said engine, a movable valve element of a regulating valve means disposed downstream of each of said metering valves for regulating the pressure difference at each of said metering valve means, a control pressure line communicating with said fuel supply line, a control throttle means at one end of said control pressure line, a return-flow throttle means at the other end of said control pressure line, individual injection valve means positioned ahead of each cylinder of said engine and connected to said fuel supply line by means of said regulating valve means, and a supplementary injection valve means connected to said control pressure line, whereby fuel can be additionally injected into the air-intake tube of said engine in accordance with engine operating characteristics.

6. A system defined by claim 5 wherein said supplementary injection valve means communicates with said control pressure line downstream of said control throttle.

7. A system as defined by claim 5, wherein said supplementary injection valve means for the injection of fuel is triggerable by means of control signals responsive to an acceleration of said engine.

8. A system as defined by claim 5, wherein said supplementary injection valve means for the injection of fuel is triggerable by means of control signals responsive to the starting of said engine.

9. A system as defined by claim 5, wherein said supplementary injection-valve means communicates by means of a limitation throttle with said control pressure line.

* * * * *